US008217574B2

(12) United States Patent
Ramachandran et al.

(10) Patent No.: US 8,217,574 B2
(45) Date of Patent: Jul. 10, 2012

(54) LAMP WITH INTERNAL FUSE SYSTEM

(75) Inventors: Balasubramanian Ramachandran, Santa Clara, CA (US); Nyi Oo Myo, Campbell, CA (US); Joseph M. Ranish, San Jose, CA (US); Akio Takahashi, Ishinomaki (JP)

(73) Assignee: Applied Materials, Inc., Santa Clara, CA (US)

( * ) Notice: Subject to any disclaimer, the term of this patent is extended or adjusted under 35 U.S.C. 154(b) by 148 days.

(21) Appl. No.: 12/753,532

(22) Filed: Apr. 2, 2010

(65) Prior Publication Data

US 2010/0308729 A1 Dec. 9, 2010

Related U.S. Application Data

(60) Provisional application No. 61/166,466, filed on Apr. 3, 2009.

(51) Int. Cl.
*H01K 1/66* (2006.01)
*H01K 1/62* (2006.01)

(52) U.S. Cl. ..... 313/580; 313/579; 313/315; 313/316; 315/119

(58) Field of Classification Search ..... 313/315, 313/316, 578–580; 315/119
See application file for complete search history.

(56) References Cited

U.S. PATENT DOCUMENTS

| | | | | |
|---|---|---|---|---|
| 4,132,922 | A * | 1/1979 | Newton et al. | 313/315 |
| 4,686,411 | A * | 8/1987 | Sands | 313/315 |
| 4,686,412 | A * | 8/1987 | Johnson, Jr. | 313/315 |
| 4,897,573 | A | 1/1990 | Ooms | |
| 2006/0006800 | A1 | 1/2006 | Marchand | |
| 2007/0103047 | A1 | 5/2007 | Gibboney | |

OTHER PUBLICATIONS

International Search Report and Written Opinion mailed Oct. 28, 2010 for PCT Application No. PCT/US2010/029802.

* cited by examiner

*Primary Examiner* — Mariceli Santiago
(74) *Attorney, Agent, or Firm* — Moser Taboada; Alan Taboada

(57) ABSTRACT

Embodiments of a lamp having an internal fuse system are provided herein. In some embodiments, a lamp may include a transparent housing; a filament disposed in the housing, the filament having a main body disposed between a first end and a second end of the filament; a first conductor coupled to the filament at the first end of the filament; a first interceptor bar disposed in the housing and beneath the main body of the filament, wherein the first interceptor bar is coupled to the second end of the filament; a second conductor disposed proximate the first end of the filament and conductively coupled to the second end of the filament via the first interceptor bar, wherein the first interceptor bar is positioned such that an electrical short forms between the first and second conductors when the main body of the filament contacts the first interceptor bar.

18 Claims, 6 Drawing Sheets

LAMP WITH INTERNAL FUSE SYSTEM

CROSS-REFERENCE TO RELATED APPLICATIONS

This application claims benefit of U.S. provisional patent application Ser. No. 61/166,466, filed Apr. 3, 2009, which is herein incorporated by reference in its entirety.

FIELD

Embodiments of the present invention generally relate to lamps used, for example, in semiconductor processing equipment.

BACKGROUND

Lamps, for example, light bulbs, halogen lamps, or the like, typically include a filament disposed in a transparent housing. The filament may include tungsten (W) or another suitable material. Some lamps may be used in process chambers for processing semiconductor wafers or other substrates, for example, in epitaxial growth (Epi) chambers, or other chambers utilizing light sources, such as rapid thermal processing chambers (RTP) or the like. The Inventors have discovered that due to the high temperatures reached by these filaments during use, the filament tends to sag as the material of the filament softens and expands at increased temperatures. The sagging filament may come into close proximity or may contact the housing of the lamp, causing the housing to weaken. Due to this weakening of the housing, the housing may burst as gases, such as halogen and inert gases, expand within the weakened housing as the lamp temperature increases. In addition to destroying the lamp, the bursting of one lamp can cause damage to or can destroy adjacent lamps as well. Although some lamps include support structures to support the filament in an attempt to prevent the filament from sagging, unfortunately, the inventors have found these support structures to be inadequate for preventing the filament from sagging and damaging the housing.

Accordingly, the inventors have provided an improved lamp to overcome at least some of the aforementioned problems.

SUMMARY

Embodiments of a lamp having an internal fuse system are provided herein. In some embodiments, a lamp may include a transparent housing; a filament disposed in the housing, the filament having a main body disposed between a first end and a second end of the filament; a first conductor coupled to the filament at the first end of the filament; a first interceptor bar disposed in the housing and beneath the main body of the filament, wherein the first interceptor bar is coupled to the second end of the filament; a second conductor disposed proximate the first end of the filament and conductively coupled to the second end of the filament via the first interceptor bar, wherein the first interceptor bar is positioned such that an electrical short forms between the first and second conductors when the main body of the filament contacts the first interceptor bar.

In some embodiments, the lamp further includes a fuse element to couple the second conductor to the first interceptor bar proximate the first end of the filament.

In some embodiments, the lamp further includes a second interceptor bar disposed in the transparent housing and beneath the main body of the filament; and a fuse element to couple the second interceptor bar to the first conductor proximate the first end of the filament, wherein the second interceptor bar is electrically floating during desired operation of the lamp and wherein an electrical short forms between the first and second conductors when the main body of the filament contacts the first and second interceptor bar.

In some embodiments, a lamp may include a transparent housing; a filament disposed in the housing, the filament having a main body disposed between a first end and a second end of the filament; a first conductor coupled to the first end of the filament; a first interceptor bar disposed in the housing and beneath the main body of the filament, the first interceptor bar coupled to the second end of the filament; and a second conductor coupled to the second end of the filament via the first interceptor bar; wherein the first interceptor bar is positioned such that a first current path is formed between the first and second conductors during normal operation of the lamp when the main body of the filament does not contact the first interceptor bar, and a second current path is formed between the first and second conductors when the main body of the filament contacts the first interceptor bar, and wherein the second current path is shorter than the first current path.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1A:
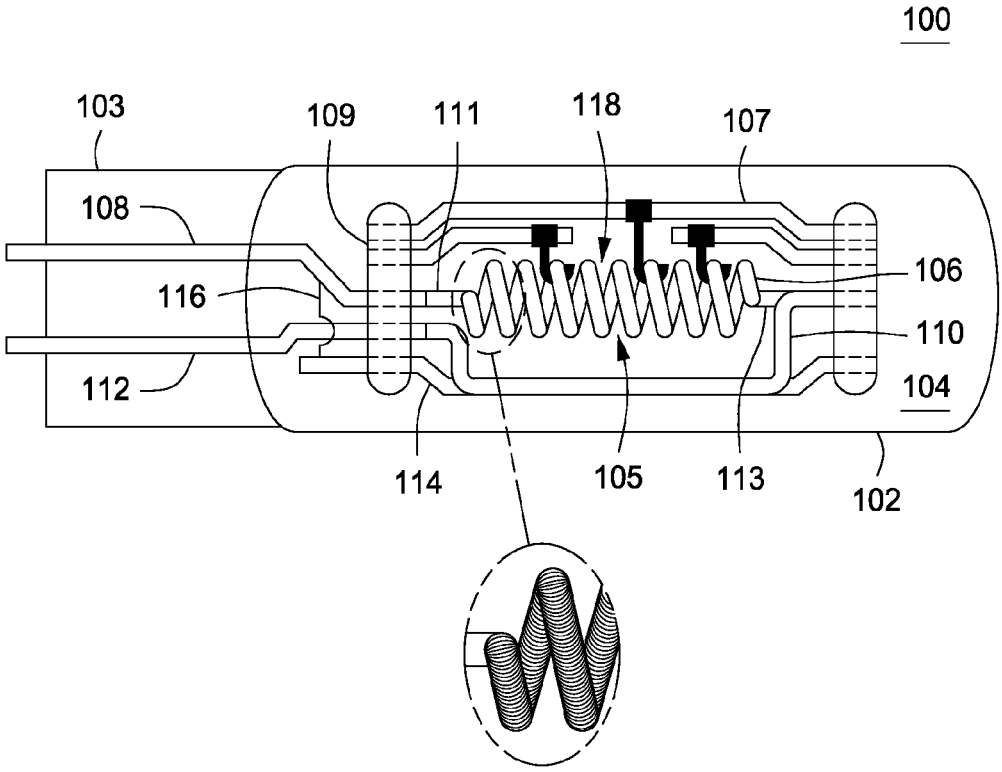
FIGS. 1A-B depict side and bottom cross sectional views of a lamp in accordance with some embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of a lamp having an internal fuse system are provided herein. The lamp advantageously provides an internal fuse system that can short the filament of the lamp upon sagging towards the housing. The improved design facilitates disabling the lamp prior to the filament damaging or weakening the lamp housing. Disabling the lamp prior to damage of the lamp housing reduces the incidence of lamp explosions and damage to other lamps disposed proximate to an exploding lamp.

Figure 1B:
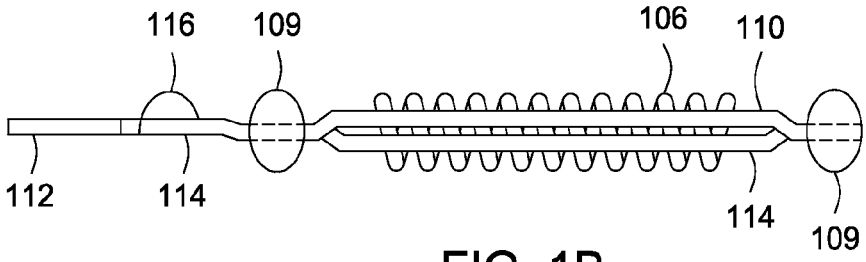

An exemplary embodiment of a lamp in accordance with some embodiments of the present invention is illustrated in FIGS. 1A-B. FIG. 1A depicts a side cross section view of a lamp 100 in accordance with some embodiments of the present invention. The lamp 100 may be oriented horizontally in a process chamber (such as a process chamber 400, discussed below) as depicted in FIG. 1A. The lamp 100 includes a transparent housing 102 having interior volume 104. Disposed within the interior volume 104 is a filament 106. The filament 106 includes a main body 105 disposed between a first end 111 and a second end 113 of the filament 106. The filament 106 is coupled at the first end 111 to a first conductor 108. The filament 106 may be supported by one or more support structures 107 which extend from one or more support bases 109 disposed within the interior volume 104. A conductive first interceptor bar 110 is disposed within the housing 102 beneath the filament 106 and is coupled between the second end 113 of the filament 106 and a second conductor 112. During typical operation, current flows into the lamp via the first conductor 108, completely through the filament 106, along the first interceptor bar 110, and exits the lamp via the second conductor 112.

In some embodiments, the lamp 100 further includes a second interceptor bar 114 disposed within the transparent housing beneath the filament 106 and coupled to the first conductor 108 via a fuse element 116. As depicted in FIG. 1A, and during normal operation, the second interceptor bar 114 is electrically floating.

A bottom cross sectional view of the lamp 100 is depicted in FIG. 1A. As illustrated, the first and second interceptor bars 110, 114 of the lamp 100 are substantially parallel and do not contact each other. The first and second interceptor bars 110, 114 are disposed directly underneath the filament 106, such that a sagging filament will likely contact one or both of the first and second interceptor bars 110, 114. The lamp 100 is merely one exemplary embodiment of the invention, and first and second interceptor bars can have other configurations, as illustrated in FIGS. 3A-D below.

The housing 102 may be formed of a transparent or semi-transparent material, such as quartz, glass, or other suitable materials. The housing 102 includes the interior volume 104. As illustrated in FIG. 1A, the interior volume 104 may substantially contain the filament 106, the first and second interceptor bars 110, 114, the fuse element 116, the support bases 109, and the support structures 107. This is merely exemplary and other embodiments are possible. The housing may further include a base 103 having the first and second conductors 108, 112 disposed therethrough. The base 103 may provide support to the lamp 100, such as by being held in a socket assembly (not shown) or other similar structure. The interior volume 104 may be filled with an inert gas, for example, argon, helium, or the like, and further with a lesser amount of a halogen gas, such as iodine or bromine.

The filament 106 typically comprises tightly coiled wire that is then wrapped into a plurality of coils 118 as shown in FIGS. 1A-B. The plurality of coils 118 may form the main body 105 of the filament 106. However, other configurations of the filament are possible, such as loops, helices, or other suitable coil-like configurations. The increased length, and current path, of the filament, for example, by providing coils 118 and secondary coils, can increase resistance through the filament 106, which can allow the lamp to operate at lower currents. The filament may be formed of tungsten (W) or another suitable filament material. The filament may further be supported by one or more support structures 107 as depicted in FIG. 1A. The support structures 107 can support the filament at various points over the length of the filament, as shown in FIG. 1A. The support structures 107 typically support the filament from above. The support base 109 may comprise quartz, or the same material of which the housing is comprised.

The first and second interceptor bars 110, 114 are disposed below the filament 106 and do not directly contact the coiled region of the filament 106 during typical operation of the lamp 100. However, when the filament heats due to current flowing therethrough, one or more portions of the filament may sag due to gravity and may contact either or both of the first or second interceptor bars 110, 114. The first and second interceptor bars 110, 114 may be formed of any suitable conducting material, such as copper or the like. Although depicted as linear, either or both of the first or second interceptor bars 110, 114 may have any suitable geometry suitable to be disposed between a sagging portion of the filament 106 and the lamp housing 102 (e.g., to reduce the likelihood of, or to prevent, the filament 106 coming into contact with the lamp housing 102).

The second interceptor bar 114 can be electrically floating and may be coupled to the first conductor 108 via the fuse element 116. The fuse element 116 may be, for example, a short bar or fuse, and may vary in rating depending on the configuration of the filament and/or the lamp in general. For example, if the filament configuration or composition is such that resistance along a current path fails to provide a suitable increase in current necessary to melt the filament and break the circuit when the filament sags and contacts the second interceptor bar 114, the fuse element 116 may be configured to have a reduced resistance such that the circuit draws more current and the filament melts prior to damaging the housing of the lamp. Varying the resistance of the fuse element 116 may be accomplished, for example, by changing the material and/or the thickness of the fuse element. The fuse element may be formed of conducting materials, such as a suitable metal or metal-containing material, or the like. The thickness of the fuse element may be between about 0.01 mm to about 2 mm.

Figure 1C:
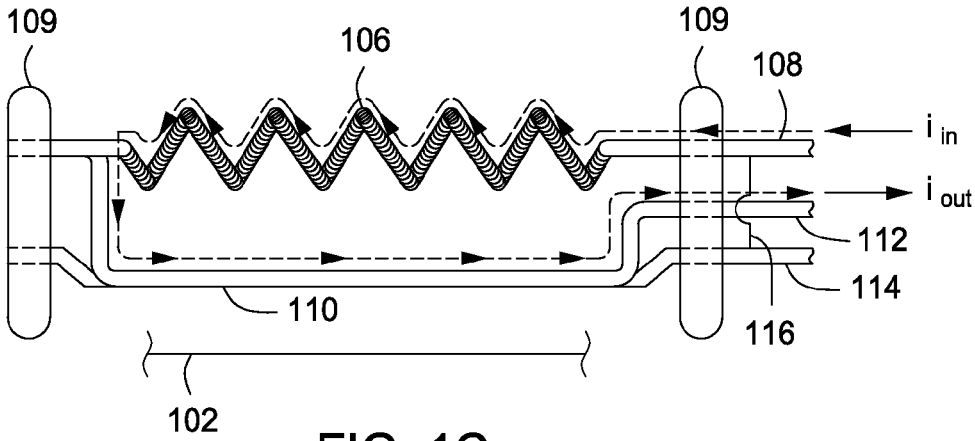
FIGS. 1C-E depict schematic current flow diagrams for the lamp of FIGS. 1A-B during typical operational and failure modes.
Figure 1D:
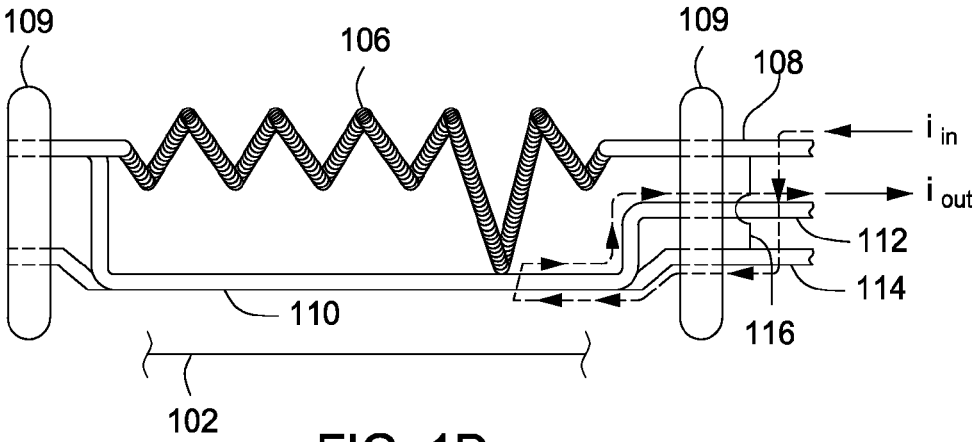
Figure 1E:
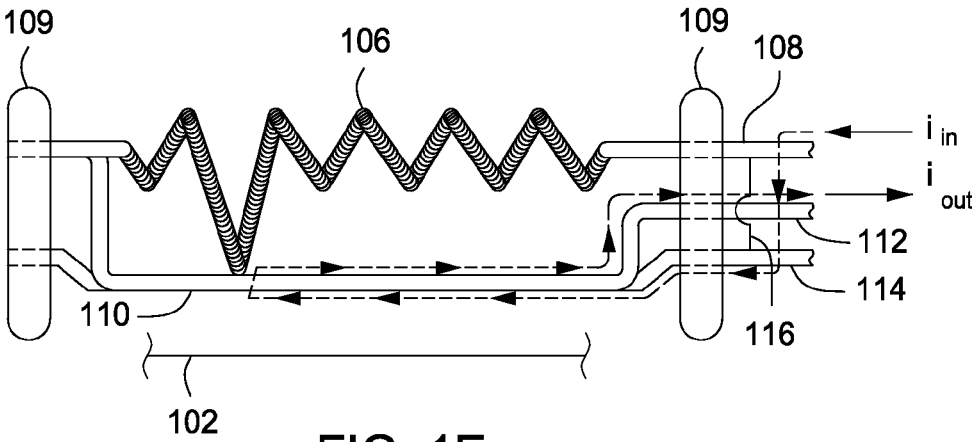

FIGS. 1C-E depict schematic current flow diagrams for the lamp of FIGS. 1A-B during typical operational and failure modes. As shown in FIG. 1C, during standard operation, current flows into the lamp via conductor 108, through the filament 106, and out of the lamp via the conductor 112. If, during operation, the filament 106 sags, it will likely come into contact with both the first and the second interceptor bars 110, 114. FIG. 1D depicts the current flow through the lamp if the filament sags close to the base of the housing (e.g., base 103 depicted in FIGS. 1A-B). In such an instance, the current will bypass the filament 106 via the fuse element 116 and will travel along the second interceptor bar 114, jump across the filament 106 at the point of contact with the first and second interceptor bars 110, 114, and back out of the lamp via the conductor 112. As such, in addition to preventing the filament 106 from contacting the housing 102, current will no longer travel through the entire filament 106, and the filament 106 will cool (as it is no longer heated by the current). FIG. 1E similarly depicts the current diagram in the case where the filament 106 sags and contacts the first and the second interceptor bars 110, 114 at a point further from the base of the housing 102.

Figure 2A:
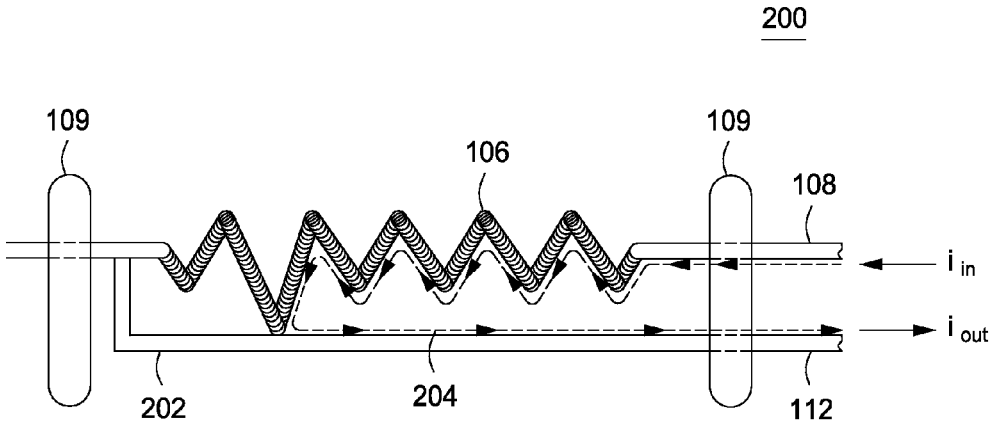
FIGS. 2A-B depict schematic views of a lamp in accordance with some embodiments of the present invention.
Figure 2B:
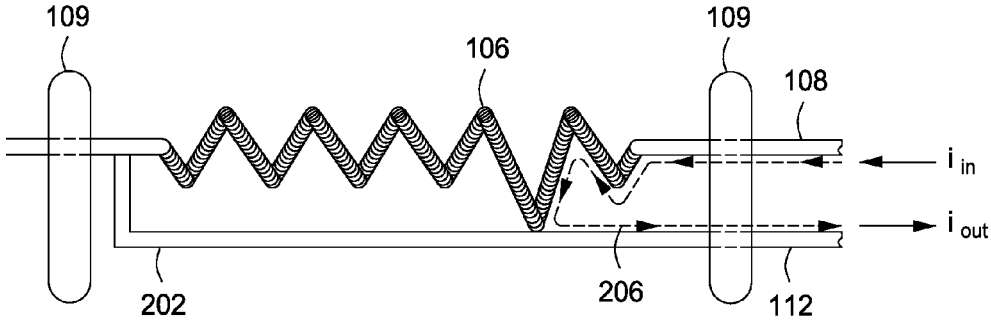

FIGS. 2A-B depict a schematic view of a lamp 200 in accordance with some embodiments of the present invention. The lamp 200 is generally similar to the lamp 100 with the exception that the lamp 200 includes only one interceptor bar 202 disposed beneath the filament 106. The interceptor bar 202 is similar to the interceptor bar 110, and likewise couples the second conductor 112. Other elements of the lamp 200, such as the housing 102, support structures 107, and the like are omitted from this simplified schematic view, but are similar to the elements described with respect to the lamp 100 in FIGS. 1A-B.

The embodiments of the lamp 200 depicted in FIGS. 2A-B demonstrate a current path when the filament sags far away from (FIG. 2A) or proximate (FIG. 2B) the first and second conductors 108, 112 (e.g., the base of the housing). For example, FIG. 2A illustrates the filament 106 sagging proximate an end of the filament farthest from the first and second conductors 108, 112. The filament 106 contacts the interceptor bar 202 disposed below the sagging section of the filament 106, and a current path 204 is formed. The current path 204 is shorter than a typical current path that would exist if the sagging section of the filament does not contact the interceptor bar 202. As such, the current path 204 can have a lower resistance than the typical current path and thus draws a larger current. The larger current can cause the filament temperature to increase to the point where the filament melts, and breaks the current path 204 between the first and second conductors 108, 112. In some instances, the filament 106 may not melt, however, the interceptor bar 202 may still facilitate keeping the sagging filament 106 from touching the housing 102 and reducing the likelihood of lamp failure or explosion.

Similarly, and as illustrated in FIG. 2B, the filament 106 may sag proximate an end of the filament located near the first and second conductors 108, 112. The filament 106 contacts the interceptor bar 202 disposed below the sagging section, and a current path 206 is formed. As illustrated, the current path 206 may be shorter than the current path 204, and thus provide a greater reduction in the resistance between the first and second conductors 108, 112. The reduced resistance resulting from the current path 206 allows for a larger current to be drawn through any portion of the filament 106 along the current path 206, and thus can cause an increase in the temperature of the filament along that portion. The temperature increase can result in the filament melting along that portion, and breaking the circuit between the first and second conductors 108, 112.

Another exemplary embodiment of a lamp 300 in accordance with some embodiments of the present invention is depicted in FIGS. 3A-D. The lamp 300 is depicted in a schematic view, and is generally similar to the lamp 100 with the exception that the lamp 300 includes a first interceptor bar 302 coupled between the second end of the filament 106 and the second conductor 112, similar to the first interceptor bar 110 of FIGS. 1A-B. A second interceptor bar 304 is normally electrically floating and is coupled to the first conductor via fuse element 116.

The first and second interceptor bars 302, 304 may be substantially vertically aligned and may include a crossover 305 such that a first portion of the first interceptor bar 302 disposed near the second end of the filament 106 is situated closer to the filament 106 than the second interceptor bar 304 and such that a first portion of the second interceptor bar 304 disposed near the first end of the filament 106 is situated closer to the filament 106 than the first interceptor bar 306. As such, each interceptor bar 302, 304 includes a portion that is nearer to the filament 106 than the other and that cross over each other without contacting at crossover 305. The crossover 305 may be disposed in any suitable location. In some embodiments, the crossover 305 is substantially in the center of the first and second interceptor bars 302, 304.

Figure 3A:
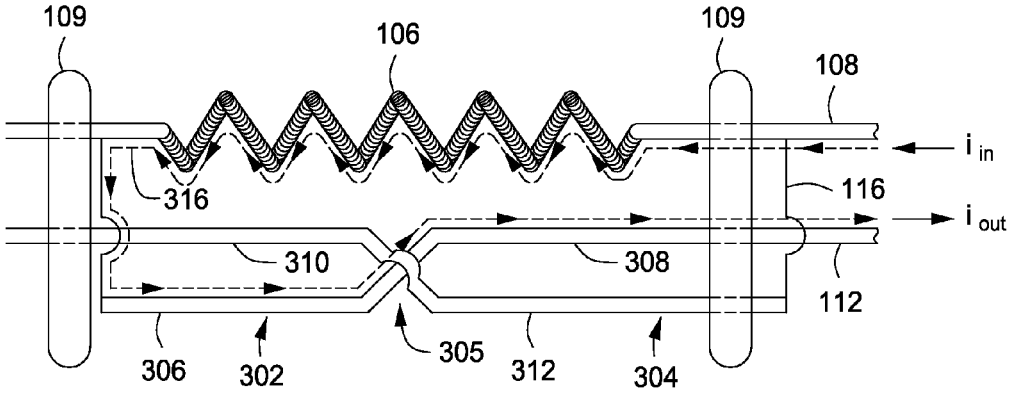
FIGS. 3A-D depict schematic views of a lamp in accordance with some embodiments of the present invention.

As such, the lamp 300 is generally configured similarly to the lamp 100 with the exception of the shape of the first and second interceptor bars 302, 304. Here, the first interceptor bar 302 is non-linear and having a first end 306 proximate the terminal end of the filament 106 and a second end 308 proximate the first and second conductors 108, 112. The first end 306 is spaced farther from the filament 106 than the second end 308. The second interceptor bar 304 is non-linear and having a first end 310 proximate the terminal end of the filament 106 and a second end 312 proximate the first and second conductors 108, 112. Contrary to the first interceptor bar 302, in the second interceptor bar 304, the first end 310 is spaced closer to the filament 106 than the second end 312. Accordingly, the first and second interceptor bars cross over at a crossover 305. In some embodiments, and as shown in FIG. 3A, the crossover 305 may be formed below about a middle length of the filament. However, the crossover 305 may be formed at other positions along the length of the filament as well. Generally, during typical operation of the lamp 300, a current path 316 may include current entering at the first conductor 108, traveling through the filament 106, then into the first interceptor bar 302 and finally out through the second conductor 112.

Figure 3B:
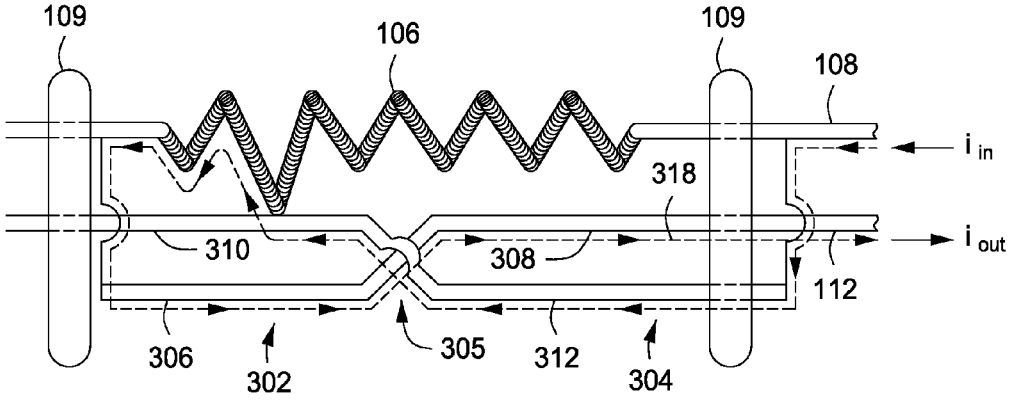
Figure 3C:
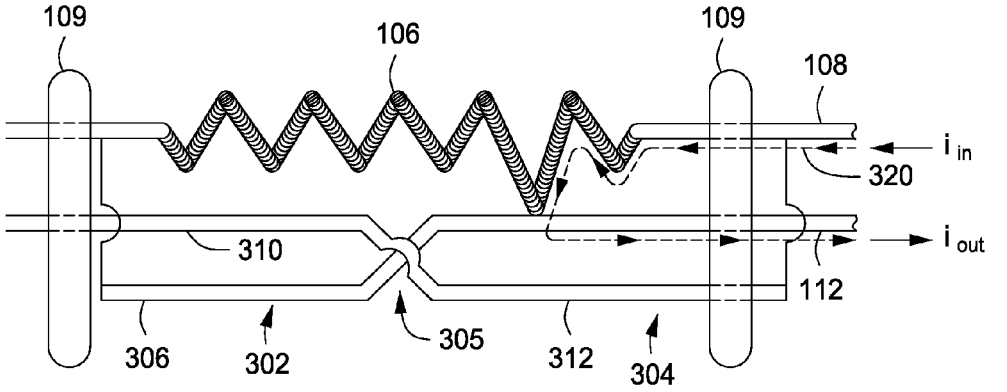

FIGS. 3B-C depict current paths formed between the first and second conductors 108, 112 when the filament 106 sags at different positions along the length of the filament. For example, FIG. 3B depicts a failure mode where the filament 106 sags proximate the terminal, or second end of the filament. In such an embodiment, a current path 318 is formed when the sagging portion of the filament 106 contacts the second interceptor bar 304 proximate the first end 310. The current path 318 includes current entering at the first conductor 108, traveling through the fuse element 116, the second interceptor bar 304, the filament proximate the contact point between the sagging portion and the second intercept bar 304, the first interceptor bar 302, and then finally out through the second conductor 112. The current path 318 can be substantially shorter than the current path 316 as a substantial portion of the coiled path of the filament 106 is effectively removed from the circuit. As such, the current path 318 can draw a higher current than the current path 316 which may cause the portion of the filament 106 along the current path 318 to melt, resulting in a break of current flow between the first and second conductors 108, 112 and stopping the flow of current through the lamp.

In some embodiments, the filament 106 may sag proximate the first and second conductor 108, 112 as shown in FIG. 3C. In such an embodiment, a current path 320 is formed when the sagging portion of the filament 106 contacts the first interceptor bar 302 proximate the second end 308. As illustrated in FIG. 3C, the current path 320 includes current entering at the first conductor 108, traveling through the filament 106, the first interceptor bar 302 proximate the sagging portion of the filament, and then finally out through the second conductor 112. The current path 320 can be substantially shorter than the current path 316 as a substantial portion of the coiled path of the filament 106 is effectively removed from the circuit. As such, the current path 320 can draw a higher current than the current path 316 causing the portion of the filament along the current path 320 to melt, resulting in a break of current flow between the first and second conductors 108, 112 and stopping the flow of current through the lamp.

Figure 3D:
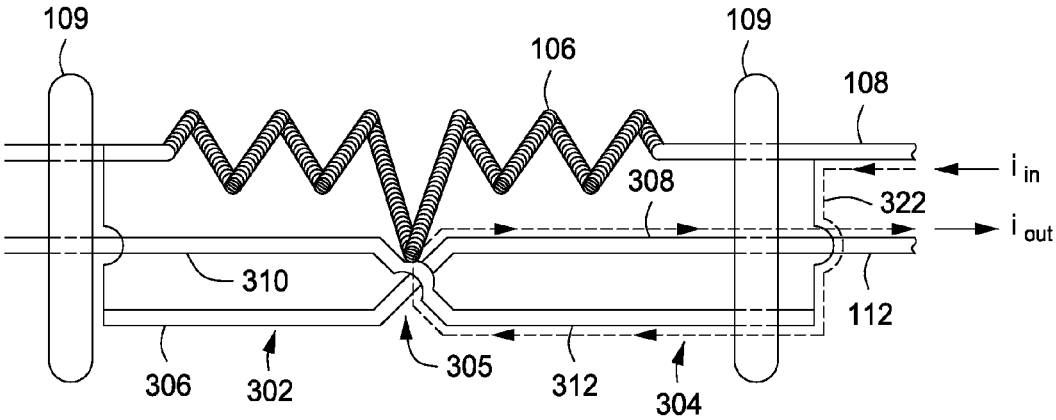

In some embodiments, the filament 106 may sag proximate the crossover 305 as shown in FIG. 3D. In such an embodiment, a current path 322 is formed when the sagging portion of the filament 106 contacts the first and second interceptor bars 302, 304 at the crossover 305. The current path 322 includes current entering at the first conductor 108, traveling through the fuse element 116, the second interceptor bar 304, the sagging portion of the filament at the crossover 305, the first intercept bar 302, and then finally exits through the second conductor 112. The current path 322 can be substantially shorter than the current path 316 as a substantial portion of the coiled path of the filament 106 is effectively removed from the circuit. As such, the current path 322 can draw a higher current than the current path 316 causing the portion of the filament along the current path 322 (e.g., at the crossover 305) to melt resulting in a break of current flow between the first and second conductors 108, 112 and stopping the flow of current through the lamp.

Figure 5:
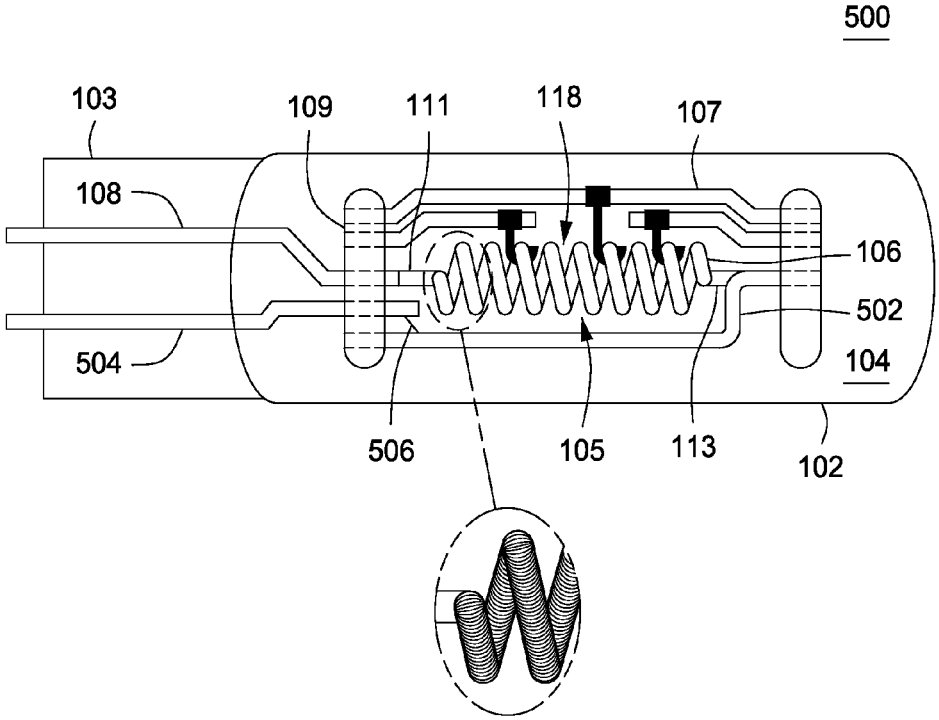
FIG. 5 depicts a schematic side view of a lamp in accordance with some embodiments of the present invention.

FIG. 5 depicts a side view of a lamp 500 in accordance with some embodiments of the present invention. The lamp 500 may be oriented horizontally in a process chamber (such as a process chamber 400, discussed below) as depicted in FIG. 5. The lamp 500 has several similar component as the lamp 100, and accordingly is described using the same reference numerals for those components. The lamp 500 includes the transparent housing 102 having interior volume 104. Disposed within the interior volume 104 is the filament 106. The filament 106 is coupled at the first end 111 to the first conductor 108. The filament 106 may be supported by one or more support structures 107 which extend from one or more support bases 109 disposed within the interior volume 104. An interceptor bar 502 is disposed within the housing 102 beneath the filament 106 and is coupled between the second end 113 of the filament 106. The opposing end of the interceptor bar 502 is coupled to a second conductor 504 via a fuse element 506. The fuse element 506 may be substantially similar in composition to the fuse element 116 discussed above. During typical operation, current flows into the lamp 500 via the first conductor 108, completely through the filament 106, along the interceptor bar 502, through the fuse element 506 and exits the lamp 500 via the second conductor 504. If portions of the lamp overheat, for example, if the main body 105 of the filament sags and contacts the interceptor bar 502, the current path between the first and second conductors will be shortened due to the main body 105 contacting the interceptor bar 502. Accordingly, as discussed above, the shortened current path will have lower resistance, thus resulting in a higher current flow along the shortened path. The higher current flow of the shortened current path will then cause the fuse element 506 to fail, thus causing a break in the current flow and preventing or limiting damage to the transparent housing 102.

Embodiments of the lamp described above may be utilized as part of a bank of lamps, for example, a bank of lamps in a processing chamber, such as those used for Epitaxial deposition and RTP processes. The lamps may be linked together in series. In some embodiments, the lamps may be configured in a series of two lamps, three lamps, four lamps, or the like. In some embodiments, a series of four lamps may be operated using a voltage of about 120 V. In some embodiments, a series of two lamps may be operated using a voltage of about 240 V. However, other voltages and lamp bank configurations may be utilized with lamps according to the present invention.

Embodiments of the inventive lamps disclosed herein may be used in any suitable semiconductor process chamber, including those adapted for performing epitaxial silicon deposition processes, such as the RP EPI reactor, available from Applied Materials, Inc. of Santa Clara, Calif. An exemplary process chamber is described below with respect to FIG. 4, which depicts a schematic, cross-sectional view of a semiconductor substrate process chamber 400 suitable for performing portions of the present invention. The process chamber 400 may be adapted for performing epitaxial silicon deposition processes and illustratively comprises a chamber body 410, support systems 430, and a controller 440.

The chamber body 410 generally includes an upper portion 402, a lower portion 404, and an enclosure 420. The upper portion 402 is disposed on the lower portion 404 and includes a lid 406, a clamp ring 408, a liner 416, a baseplate 412, one or more upper lamps 436 and one or more lower lamps 452, and an upper pyrometer 456. In some embodiments, the lid 406 has a dome-like form factor, however, lids having other form factors (e.g., flat or reverse curve lids) are also contemplated. The lower portion 404 is coupled to a process gas intake port 414 and an exhaust port 418 and comprises a baseplate assembly 421, a lower dome 432, a substrate support 424, a pre-heat ring 422, a substrate lift assembly 460, a substrate support assembly 464, one or more upper lamps 438 and one or more lower lamps 454, and a lower pyrometer 458. Although the term "ring" is used to describe certain components of the process chamber 400, such as the pre-heat ring 422, it is contemplated that the shape of these components need not be circular and may include any shape, including but not limited to, rectangles, polygons, ovals, and the like.

During processing, the substrate 200 is disposed on the substrate support 424. The lamps 436, 438, 452, and 454 are sources of infrared (IR) radiation (i.e., heat) and, in operation, generate a pre-determined temperature distribution across the substrate 200. The lid 406, the clamp ring 408, and the lower dome 432 are formed from quartz; however, other IR-transparent and process compatible materials may also be used to form these components.

The substrate support assembly 464 generally includes a support bracket 434 having a plurality of support pins 466 coupled to the substrate support 424. The substrate lift assembly 460 comprises a substrate lift shaft 426 and a plurality of lift pin modules 461 selectively resting on respective pads 427 of the substrate lift shaft 426. In one embodiment, a lift pin module 461 comprises an optional upper portion of the lift pin 428 is movably disposed through a first opening 462 in the substrate support 424. In operation, the substrate lift shaft 426 is moved to engage the lift pins 428. When engaged, the lift pins 428 may raise the substrate 200 above the substrate support 424 or lower the substrate 425 onto the substrate support 424.

The support systems 430 include components used to execute and monitor pre-determined processes (e.g., growing epitaxial silicon films) in the process chamber 400. Such components generally include various sub-systems. (e.g., gas panel(s), gas distribution conduits, vacuum and exhaust subsystems, and the like) and devices (e.g., power supplies, process control instruments, and the like) of the process chamber 400. These components are well known to those skilled in the art and are omitted from the drawings for clarity.

Figure 4:
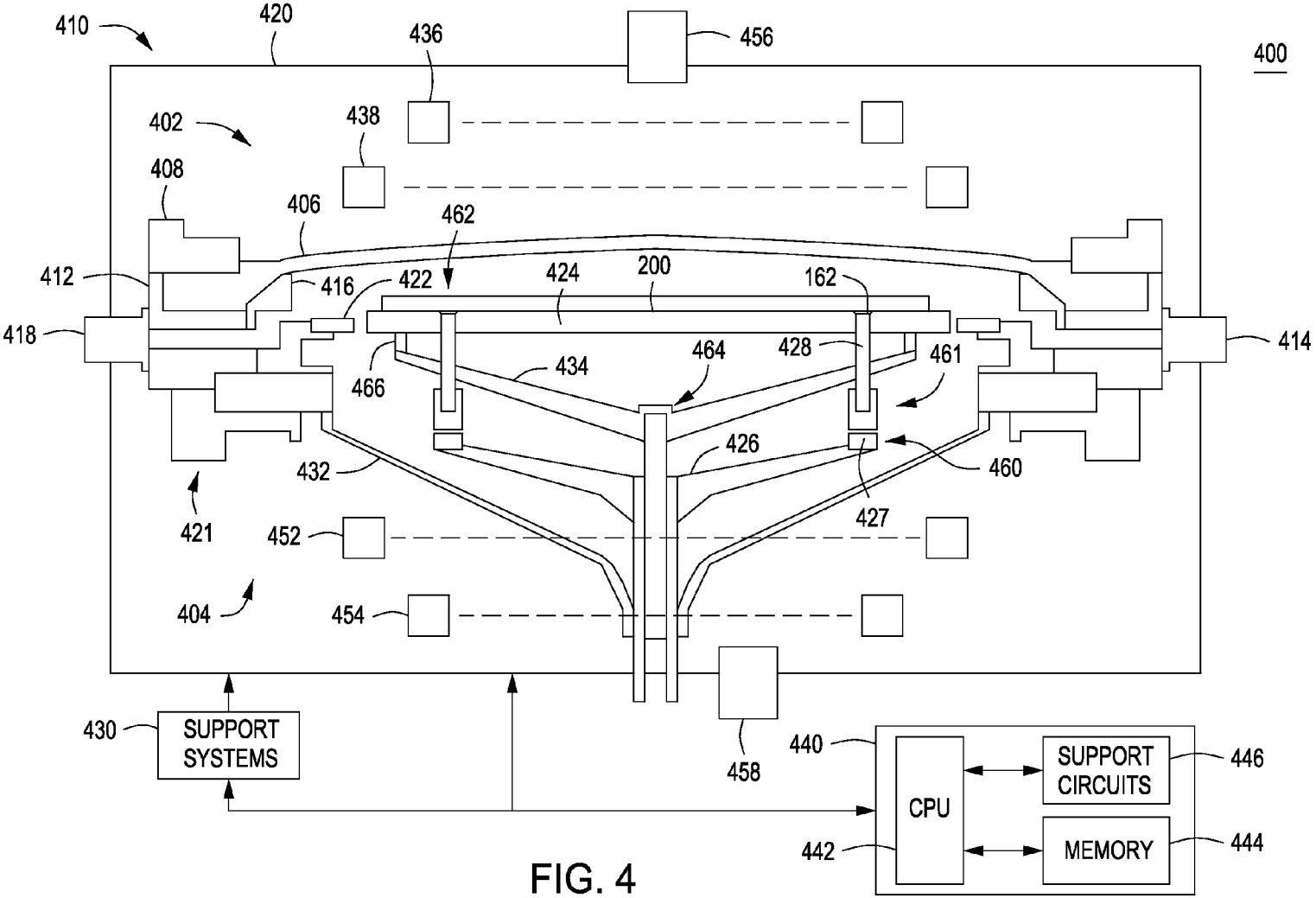
FIG. 4 depicts an exemplary process chamber that may be utilized with embodiments of the invention disclosed herein.

The controller 440 generally comprises a Central Processing Unit (CPU) 442, a memory 444, and support circuits 446 and is coupled to and controls the process chamber 400 and support systems 4330, directly (as shown in FIG. 4) or, alternatively, via computers (or controllers) associated with the process chamber and/or the support systems.

Thus, embodiments of a lamp having an internal fuse system are provided herein. During failure modes of operation, the lamp may advantageously be shorted by the internal fuse system, such that the lamp is disabled prior to a sagging filament damaging or weakening the housing that surrounds the filament. Disabling the lamp prior to damaging or weakening the housing can prevent further damage resulting from an explosion of the housing, which also may damage or destroy other lamps near the failed lamp.

While the foregoing is directed to embodiments of the present invention, other and further embodiments of the invention may be devised without departing from the basic scope thereof.

The invention claimed is:

1. A lamp, comprising:

a transparent housing;

a filament disposed in the housing, the filament having a main body disposed between a first end and a second end of the filament;

a first conductor coupled to the filament at the first end of the filament;

a first interceptor bar disposed in the housing and beneath the main body of the filament, wherein the first interceptor bar is coupled to the second end of the filament;

a second interceptor bar disposed in the transparent housing and beneath the main body of the filament;

a fuse element coupling the second interceptor bar to the first conductor proximate the first end of the filament, wherein the second interceptor bar is electrically floating during normal operation of the lamp; and a second conductor disposed proximate the first end of the filament and conductively coupled to the second end of the filament via the first interceptor bar, wherein the first interceptor bar is positioned such that an electrical short forms between the first and second conductors when the main body of the filament contacts the first interceptor bar.

2. The lamp of claim 1, wherein an electrical short forms between the first and second conductors when the main body of the filament contacts the first and second interceptor bar.

3. The lamp of claim 1, wherein the first interceptor bar further comprises:

a first portion of the first interceptor bar disposed beneath the main body and proximate the first end of the filament; and a second portion of the first interceptor bar disposed beneath the main body and proximate the second end of the filament, wherein the first portion is closer to the main body of the filament than the second portion.

4. The lamp of claim 3, wherein the second interceptor bar further comprises:

a first portion of the second interceptor bar disposed beneath the main body and proximate the first end of the filament; and a second portion of the second interceptor bar disposed beneath the main body and proximate the second end of the filament, wherein the second portion is closer to the main body of the filament than the first portion.

5. The lamp of claim 4, wherein an electrical short forms between the first and second conductors when the main body of the filament contacts the second portion of the second interceptor bar.

6. The lamp of claim 4, wherein an electrical short forms between the first and second conductors when the main body of the filament contacts the first portion of the first interceptor bar.

7. The lamp of claim 4, further comprising:

a non-contacting crossover junction formed between the first interceptor bar and the second interceptor bar.

8. The lamp of claim 7, wherein an electrical short forms between the first and second conductors when the main body of the filament contacts the first and second interceptor bars at the non-contacting crossover junction.

9. The lamp of claim 1, further comprising:

one or more support structures disposed above the main body of the filament to support the main body of the filament.

10. The lamp of claim 1, wherein the main body of the filament further comprises:

a coiled wire formed into a plurality of coils.

11. A lamp, comprising:

a transparent housing;

a filament disposed in the housing, the filament having a main body disposed between a first end and a second end of the filament;

a first conductor coupled to the first end of the filament;

a first interceptor bar disposed in the housing and beneath the main body of the filament, the first interceptor bar coupled to the second end of the filament;

a second interceptor bar disposed in the transparent housing and beneath the main body of the filament;

a fuse element coupling the second interceptor bar to the first conductor, wherein the second interceptor bar is electrically floating during normal operation of the lamp; and a second conductor coupled to the second end of the filament via the first interceptor bar;

wherein the first interceptor bar is positioned such that a first current path is formed between the first and second conductors during normal operation of the lamp when the main body of the filament does not contact the first interceptor bar, and a second current path is formed between the first and second conductors when the main body of the filament contacts the first interceptor bar, and wherein the second current path is shorter than the first current path.

12. The lamp of claim 11, further comprising:

a third current path formed between the first and second conductors when the main body of the filament contacts both the first and second interceptor bars, wherein the third current path is shorter than the first current path.

13. The lamp of claim 12, wherein the first interceptor bar further comprises:

a first portion of the first interceptor bar disposed beneath the main body and proximate the first end of the filament; and a second portion of the first interceptor bar disposed beneath the main body and proximate the second end of the filament, wherein the first portion is closer to the main body of the filament than the second portion.

14. The lamp of claim 13, wherein the second interceptor bar further comprises:

a first portion of the second interceptor bar disposed beneath the main body and proximate the first end of the filament; and a second portion of the second interceptor bar disposed beneath the main body and proximate the second end of the filament, wherein the second portion is closer to the main body of the filament than the first portion.

15. The lamp of claim 14, further comprising:

a fourth current path formed between the first and second conductors when the main body of the filament contacts the second portion of the second interceptor bar, wherein the fourth current path is shorter than the first current path.

16. The lamp of claim 14, further comprising:

a fifth current path formed between the first and second conductors when the main body of the filament contacts the first portion of the first interceptor bar, wherein the fifth current path is shorter than the first current path.

17. A lamp, comprising:

a transparent housing;

a filament disposed in the housing, the filament having a main body disposed between a first end and a second end of the filament;

a first conductor coupled to the filament at the first end of the filament;

a first interceptor bar disposed in the housing and beneath the main body of the filament, wherein the first interceptor bar is coupled to the second end of the filament;

a second conductor disposed proximate the first end of the filament and conductively coupled to the second end of the filament via the first interceptor bar, wherein the first interceptor bar is positioned such that an electrical short forms between the first and second conductors when the main body of the filament contacts the first interceptor bar; and a fuse element coupling the second conductor to the first interceptor bar proximate the first end of the filament.

18. A lamp, comprising:

a transparent housing;

a filament disposed in the housing, the filament having a main body disposed between a first end and a second end of the filament;

a first conductor coupled to the first end of the filament;

a first interceptor bar disposed in the housing and beneath the main body of the filament, the first interceptor bar coupled to the second end of the filament;

a second conductor coupled to the second end of the filament via the first interceptor bar; and a fuse element couples the second conductor to the first interceptor bar proximate the first end of the filament;

wherein the first interceptor bar is positioned such that a first current path is formed between the first and second conductors during normal operation of the lamp when the main body of the filament does not contact the first interceptor bar, and a second current path is formed between the first and second conductors when the main body of the filament contacts the first interceptor bar, and wherein the second current path is shorter than the first current path.

* * * * *